US007783233B2

(12) United States Patent
Iwata et al.

(10) Patent No.: US 7,783,233 B2
(45) Date of Patent: Aug. 24, 2010

(54) DEVELOPING DEVICE INCLUDING IMPROVED CONVEYING DEVICE, PROCESS CARTRIDGE AND IMAGE FORMING APPARATUS USING THE SAME

(75) Inventors: Nobuo Iwata, Sagamihara (JP); Junichi Matsumoto, Yokohama (JP); Tomoyuki Ichikawa, Kawasaki (JP); Natsumi Katoh, Yokohama (JP); Tomoya Ohmura, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 578 days.

(21) Appl. No.: 11/748,726

(22) Filed: May 15, 2007

(65) Prior Publication Data

US 2007/0264053 A1 Nov. 15, 2007

(30) Foreign Application Priority Data

May 15, 2006 (JP) ..... 2006-134597
Dec. 22, 2006 (JP) ..... 2006-346238

(51) Int. Cl.
*G03G 15/08* (2006.01)

(52) U.S. Cl. ..... 399/256; 399/111

(58) Field of Classification Search ..... 399/254–258, 399/111

See application file for complete search history.

(56) References Cited

U.S. PATENT DOCUMENTS 3,678,895 A * 7/1972 Ohta et al. ..... 399/254
3,698,926 A * 10/1972 Furuichi ..... 399/258
4,011,835 A * 3/1977 Lewis ..... 399/254
4,891,671 A * 1/1990 Iwamasa ..... 399/257
4,913,087 A * 4/1990 Saita et al. ..... 399/257
5,331,381 A * 7/1994 Ota et al. ..... 399/258
6,295,437 B1 9/2001 Hodoshima et al.
6,366,755 B1 * 4/2002 Takashima ..... 399/254
6,628,913 B2 9/2003 Matsumoto et al.
6,816,695 B2 11/2004 Nakai et al.

(Continued)

FOREIGN PATENT DOCUMENTS

JP 05-006469 1/1993

(Continued)

OTHER PUBLICATIONS

U.S. Appl. No. 12/256,998, filed Oct. 23, 2008, Iwata et al.

(Continued)

*Primary Examiner*—Susan S Lee
(74) *Attorney, Agent, or Firm*—Oblon, Spivak, McClelland, Maier & Neustadt, L.L.P.

(57) ABSTRACT

A developing device for an image forming apparatus that uses developing agent supplied from a supplying device. The developing device includes a developing roller configured to bear the developing agent thereon and develop a toner image on an image bearing member. The device also includes a supply and circulation system configured to receive developing agent from the supplying device, and being configured to supply the developing agent to the developing roller and circulate the developing agent within the developing device. The system includes an agitate conveying member, and a circulation route having at least a portion that extends upward. The agitate conveying member is provided within the upwardly extending portion of the circulation route, and is configured to convey the developing agent upward through the upwardly extending portion of the circulation route.

15 Claims, 9 Drawing Sheets

U.S. PATENT DOCUMENTS

| | | | |
|---|---|---|---|
| 6,882,816 | B2 | 4/2005 | Tamai |
| 7,127,198 | B2 | 10/2006 | Muramatsu et al. |
| 2005/0265759 | A1 | 12/2005 | Takeuchi et al. |
| 2005/0281592 | A1 | 12/2005 | Muramatsu et al. |
| 2007/0053721 | A1 | 3/2007 | Matsumoto et al. |

FOREIGN PATENT DOCUMENTS

| | | |
|---|---|---|
| JP | 06-338306 | 12/1994 |
| JP | 2939099 | 6/1999 |
| JP | 11-338813 | 12/1999 |
| JP | 2000-89550 | 3/2000 |
| JP | 2004-358599 | 12/2004 |
| JP | 2005-156954 | 6/2005 |
| JP | 2006-58667 | 3/2006 |

OTHER PUBLICATIONS

U.S. Appl. No. 12/048,705, filed Mar. 14, 2008, Iwata, et al.
U.S. Appl. No. 07/729,850, filed Jul. 11, 1991, Iwata, et al.
U.S. Appl. No. 11/227,566, filed Sep. 16, 2005, Nagatomo, et al.
U.S. Appl. No. 12/126,441, filed May 23, 2008, Matsumoto, et al.
U.S. Appl. No. 12/129,961, filed May 30, 2008, Katoh, et al.
U.S. Appl. No. 12/130,092, filed May 30, 2008, Ohmura, et al.
U.S. Appl. No. 12/178,986, filed Jul. 24, 2008, Matsumoto, et al.

* cited by examiner

GAP δ BETWEEN AN INNER SURFACE OF A WALL 23s AND A PERIPHERY OF A VANE OF A THIRD CONVEYING SCREW 23r

GAP δ BETWEEN AN INNER SURFACE OF A WALL 23s AND A PERIPHERY OF A VANE OF A THIRD CONVEYING SCREW 23r

DEVELOPING DEVICE INCLUDING IMPROVED CONVEYING DEVICE, PROCESS CARTRIDGE AND IMAGE FORMING APPARATUS USING THE SAME

CROSS-REFERENCE TO RELATED APPLICATION

This patent specification is based on two Japanese patent applications, No. 2006-134597 filed on May 15, 2006 in the Japan Patent Office and No. 2006-346238 filed on Dec. 22, 2006 in the Japan Patent Office, the entire contents of which are incorporated by reference herein.

BACKGROUND OF THE INVENTION

1. Field of the Invention

The present disclosure generally relates to a developing device, a process cartridge, for use in an image forming apparatus including the image bearing member, such as a copy machine, a printer, a facsimile machine and a multi-function machine capable of copying, printing, and faxing, and more specially, to a developing device for improving the conveyance of a developing agent. The present disclosure ALSO relates to an image forming apparatus using the improved developing device.

2. Description of the Related Art

Conventionally, an image forming apparatus using electrophotography (e.g., copying machine, printer, facsimile, and multi-functional apparatus) includes a developing device, which uses a two-component developing agent composed of toners and carriers (and additives, as required), for example. In the art, in order to downsize such an image forming apparatus, two conveying screws have been adopted that convey circularly the developing agent to each other, while one of the screws supplies the developing agent to the developing roller.

One such image forming apparatus was disclosed in Laid-open Japanese Patent Application No. 2000-89550. The developing device includes a developing roller, two conveying screws, and so on. When toners are consumed by image forming operations, fresh toners are supplied to the developing device through a toner replenishing port equipped at the upper position of the developing device, as required. The two conveying screws agitatingly mix such fresh toners, supplied into the developing device, with a developing agent in the developing device and convey circularly. Some of the developing agent is supplied to the developing roller by one of the conveying screws, which is arranged parallel to the developing roller. The developing agent carried-up on the developing roller may be regulated to a given amount by a doctor blade. Toners in such two-component developing agent adhere to a latent image formed on a photoconductive drum when the developing roller comes to a developing area, at which the developing roller and photoconductive drum face each other. The developing device including such two conveying screws may prevent the developing agent from being unequally distributed to one side within the developing device as in a single conveying screw configuration, because the two conveying screws convey the developing agent circularly to each other. Accordingly, the developing device can adopt a toner replenishing port that occupies not an entire area in between the two rollers but rather only a part of an upper space of the developing device in the longitudinal direction. As a result, adopting the two conveying screw method described above can preferably be used to downsize the developing device and the image forming apparatus.

SUMMARY OF THE INVENTION

According to an aspect of the invention, a developing device is provided that can be used with an image forming apparatus that uses developing agent supplied from a supplying device. The developing device includes a developing roller configured to bear the developing agent thereon and develop a toner image on an image bearing member. The device also includes a supply and circulation system configured to receive developing agent from the supplying device, and being configured to supply the developing agent to the developing roller and circulate the developing agent within the developing device. The system includes an agitate conveying member, and a circulation route having at least a portion that extends upward. The agitate conveying member is provided within the upwardly extending portion of the circulation route, and is configured to convey the developing agent upward through the upwardly extending portion of the circulation route.

BRIEF DESCRIPTION OF THE DRAWINGS

FIG. 5 is a schematic cross-sectional view of an arrangement of the conveying screws in the developing device 23 of the first embodiment taken along line V.-V. in FIG. 4 in the vertical direction;

DETAILED DESCRIPTION OF THE PREFERRED EMBODIMENTS

Figure 1:
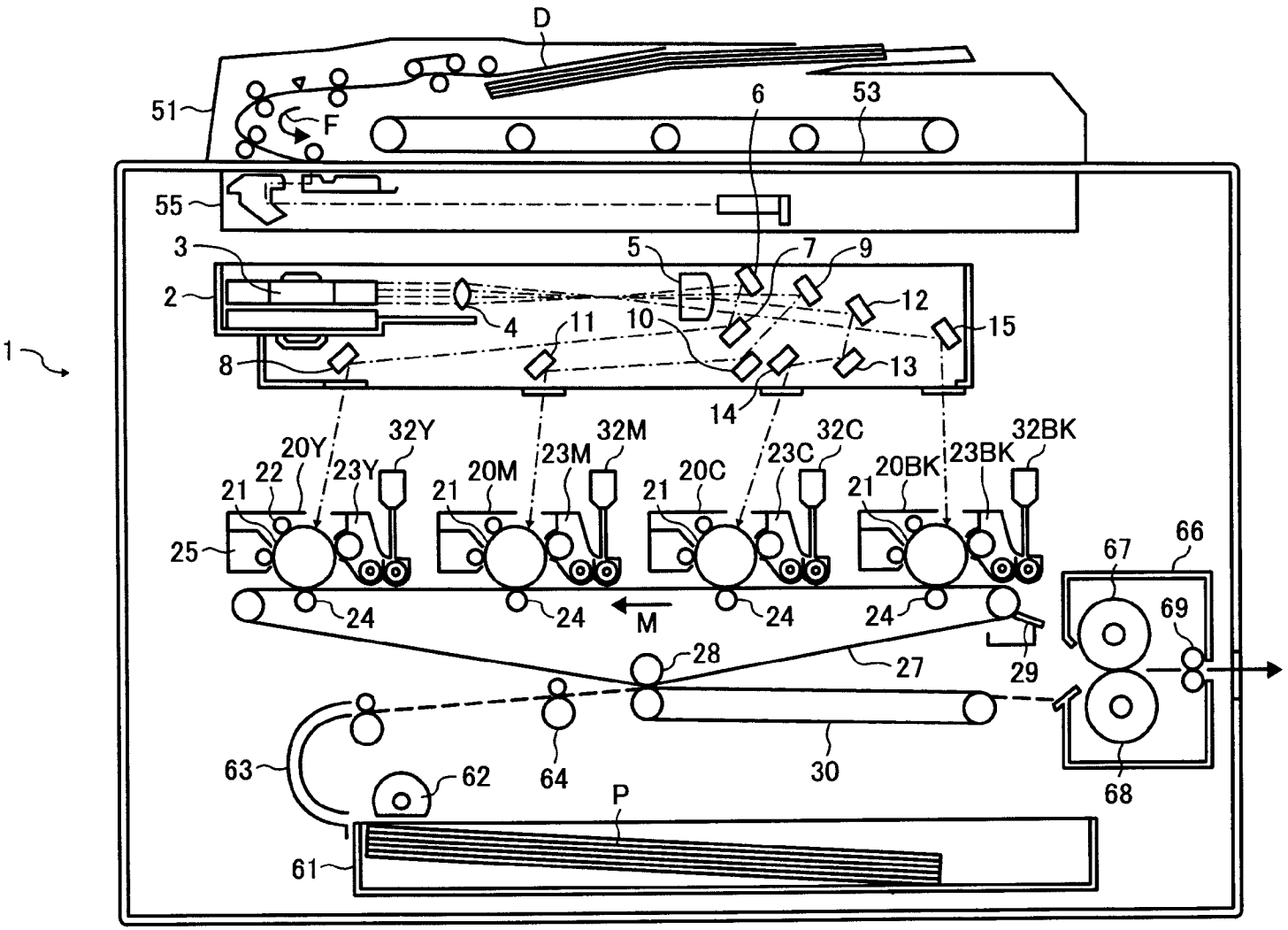
FIG. 1 is a schematic view of an image forming apparatus according to a first embodiment of the present invention.

In describing example embodiments shown in the drawings, specific terminology is employed for the sake of clarity. However, the disclosure of the present invention is not intended to be limited to the specific terminology so selected and it is to be understood that each specific element includes all technical equivalents that operate in a similar manner. In the following, the same reference characters are given to the same devices in the drawings, and explanations thereof are not repeated.

Referring now to the drawings, wherein like reference numerals designate identical or corresponding parts throughout the several views, an image forming apparatus according to a first embodiment is described with particular reference to FIG. 1. In this disclosure, a "developing agent" is used to refer to any one of "carrier," "toner," and "two-component developing agent having carrier and toner" used for a developing process, and each term is used in the following description, as required.

As shown in FIG. 1, an image forming apparatus 1 includes an optical writing device 2, and process cartridges 20Y, 20M, 20C, 20BK, each having a respective photoconductive drum 21, charger 22, primary transfer roller 24, and cleaning device 25. The apparatus 1 further includes developing device 23Y, 23M, 23C, 23BK, an intermediate transfer belt 27, a secondary transfer roller 28, a belt cleaning device 29, a transport belt 30, toner supply devices 32Y, 32M, 32C, 32BK, a document feeder 51, a scanner 55, a sheet feed device 61, and a fixing device 66.

The document feeder 51 feeds a document D to the scanner 55. The scanner 55 scans image information on the document D. The sheet feed device 61 stores the recording medium P such as transfer sheet. The fixing device 66 fixes toner images on the recording medium P. Each of the process cartridges 20Y, 20M, 20C, and 20BK can integrate the photoconductive drum 21, charger 22, and cleaning device 25, for example.

The optical writing device 2 emits a laser beam based on input image information. Each of the process cartridges 20Y, 20M, 20C, and 20BK corresponds to a process cartridge for producing yellow, magenta, cyan, and black images, respectively. The respective photoconductive drum 21 functions as an image bearing member for process cartridges 20Y, 20M, 20C, and 20BK. The charger 22 charges a surface of the photoconductive drum 21 uniformly. Each of the toner supply devices 32Y, 32M, 32C, and 32BK supplies respective color toner to each of the developing devices 23Y, 23M, 23C, and 23BK, respectively, as required. Each of the developing devices 23Y, 23M, 23C, and 23BK develops an electrostatic latent image formed on the respective photoconductive drum 21 as a toner image. Thus, each of the process cartridges 20Y, 20M, 20C, and 20BK, an image is formed of yellow, magenta, cyan, and black on the respective photoconductive drum 21. The primary transfer roller 24 transfers the toner image from the photoconductive drum 21 to the intermediate transfer belt 27. The cleaning device 25 recovers toners remaining on the photoconductive drum 21 after the toner image is transferred from the photoconductive drum 21 to the intermediate transfer belt 27.

The intermediate transfer belt 27 receives a plurality of toner images from the process cartridges 20Y, 20M, 20C, and 20BK. The secondary transfer roller 28 transfers the toner images from the intermediate transfer belt 27 to a recording medium P. The belt cleaning device 29 recovers toners remaining on the intermediate transfer belt 27 after the toner images are transferred from the intermediate transfer belt 27 to the recording medium P. The transport belt 30 transports the recording medium P having the toner images thereon.

Hereinafter, a color image forming operation in the image forming apparatus 1 is explained. The document D placed on a document tray of the document feeder 51 is transported in a direction shown by an arrow F in FIG. 1 with transport rollers, and placed on a contact glass 53 of the scanner 55. The scanner 55 optically scans image information of the document D placed on the contact glass 53. Specifically, the scanner 55 scans a light beam, generated at a light source, to an image on the document D placed on the contact glass 53. A light reflected from the document D is focused onto a color sensor (not shown) via mirrors and lenses. The color sensor reads color image information of the document D as RGB (i.e., red, green, and blue) information, and then converts RGB information to electric signals. Based on the electric signals for RGB information, an image processor (not shown) conducts various processes such as color converting process, color correction process, and spatial frequency correction process to obtain color image information of yellow, magenta, cyan, and black.

The color image information of yellow, magenta, cyan, and black are transmitted to the optical writing device 2. Then, the optical writing device 2 emits a laser beam corresponding to the color image information of yellow, magenta, cyan, and black to the respective photoconductive drum 21 in the process cartridges 20Y, 20M, 20C, and 20BK. The photoconductive drum 21 rotates in a clockwise direction in FIG. 1. The charger 22 uniformly charges a surface of the photoconductive drum 21 to form a charge potential on the photoconductive drum 21. When the charged surface of photoconductive drum 21 comes to a laser beam irradiation position, the optical writing device 2 emits a laser beam corresponding to each color of yellow, magenta, cyan, and black.

As shown in FIG. 1, the laser beam reflected at a polygon mirror 3 passes lenses 4 and 5, and then follows a separate light path for each color of yellow, magenta, cyan, and black. A laser beam for the yellow component is reflected on mirrors 6 to 8 and irradiates a surface of the photoconductive drum 21 in the process cartridge 20Y as shown in FIG. 1. The laser beam for the yellow component can be scanned in a main scanning direction of the photoconductive drum 21 with a rotation of the polygon mirror 3, rotating at a high speed. As such, an electrostatic latent image for the yellow component is formed on the photoconductive drum 21 in process cartridge 20Y. In a similar way, a laser beam for the magenta component is reflected on mirrors 9 to 11 and irradiates a surface of the photoconductive drum 21 in the process cartridge 20M as shown in FIG. 1, and an electrostatic latent image for the magenta component is formed on the photoconductive drum 21 in process cartridge 20M. In a similar way, a laser beam for the cyan component is reflected on mirrors 12 to 14 and irradiates a surface of the photoconductive drum 21 in the process cartridge 20C as shown in FIG. 1, and an electrostatic latent image for the cyan component is formed on the photoconductive drum 21 in the process cartridge 20C. In a similar way, a laser beam for the black component is reflected on a mirror 15 and irradiates a surface of the photoconductive drum 21 in the process cartridge 20BK as shown in FIG. 1, and an electrostatic latent image for black is formed on the photoconductive drum 21 in process cartridge 20BK.

Then, each of the electrostatic latent images on the respective photoconductive drum 21 comes to a position facing each of the developing devices 23Y, 23M, 23C, and 23BK. Each of the developing devices 23Y, 23M, 23C, and 23BK supplies respective color toner (i.e., yellow, magenta, cyan, and black) to the respective photoconductive drum 21 to develop respective toner image on the respective photoconductive drum 21.

After the developing process, the photoconductive drum 21 comes to a position facing the intermediate transfer belt 27. As shown in FIG. 1, four primary transfer rollers 24, provided at an inner face of the intermediate transfer belt 27, face the respective photoconductive drum 21 via the intermediate transfer belt 27. The four primary transfer rollers 24 transfer toner images on the respective photoconductive drum 21 to the intermediate transfer belt 27 by superimposing toner images on the intermediate transfer belt 27. Then, the photoconductive drum 21 comes to a position facing the cleaning device 25. The cleaning device 25 recovers toners remaining on the photoconductive drum 21. Then, a de-charger (not shown) de-charges the photoconductive drum 21 to prepare for a next image forming operation on the photoconductive drum 21.

The intermediate transfer belt 27 having toner images thereon travels in a direction shown by an arrow M in FIG. 1, and comes to a position of a secondary transfer roller 28. At the secondary transfer roller 28, the toner images are transferred from the intermediate transfer belt 27 to the recording medium P. Then, the intermediate transfer belt 27 comes to a position facing the belt cleaning device 29. The belt cleaning device 29 recovers toners remaining on the intermediate transfer belt 27. Then, a transfer process for intermediate transfer belt 27 has completed.

The recording medium P is transported to the position of the secondary transfer roller 28 from the sheet feed device 61 via a transport guide 63 and a registration roller 64. Specifically, the recording medium P, such as a transfer sheet in the sheet feed device 61, is fed to the transport guide 63 by a feed roller 62, and is further fed to the registration roller 64. The registration roller 64 feeds the recording medium P to the position of the secondary transfer roller 28 by synchronizing a feed timing with toner-image formation timing on the intermediate transfer belt 27. Then, the recording medium P having the toner images thereon is transported to the fixing device 66 by the transport belt 30.

The fixing device 66 includes a heat roller 67 and a pressure roller 68 as shown in FIG. 1. The fixing device 66 fixes the toner images on the recording medium P at a fixing nip between the heat roller 67 and pressure roller 68. After fixing the toner images on the recording medium P, the recording medium P is ejected from the image forming apparatus 1 by an ejection roller 69. Then, an image forming process of one cycle has completed.

Figure 2:
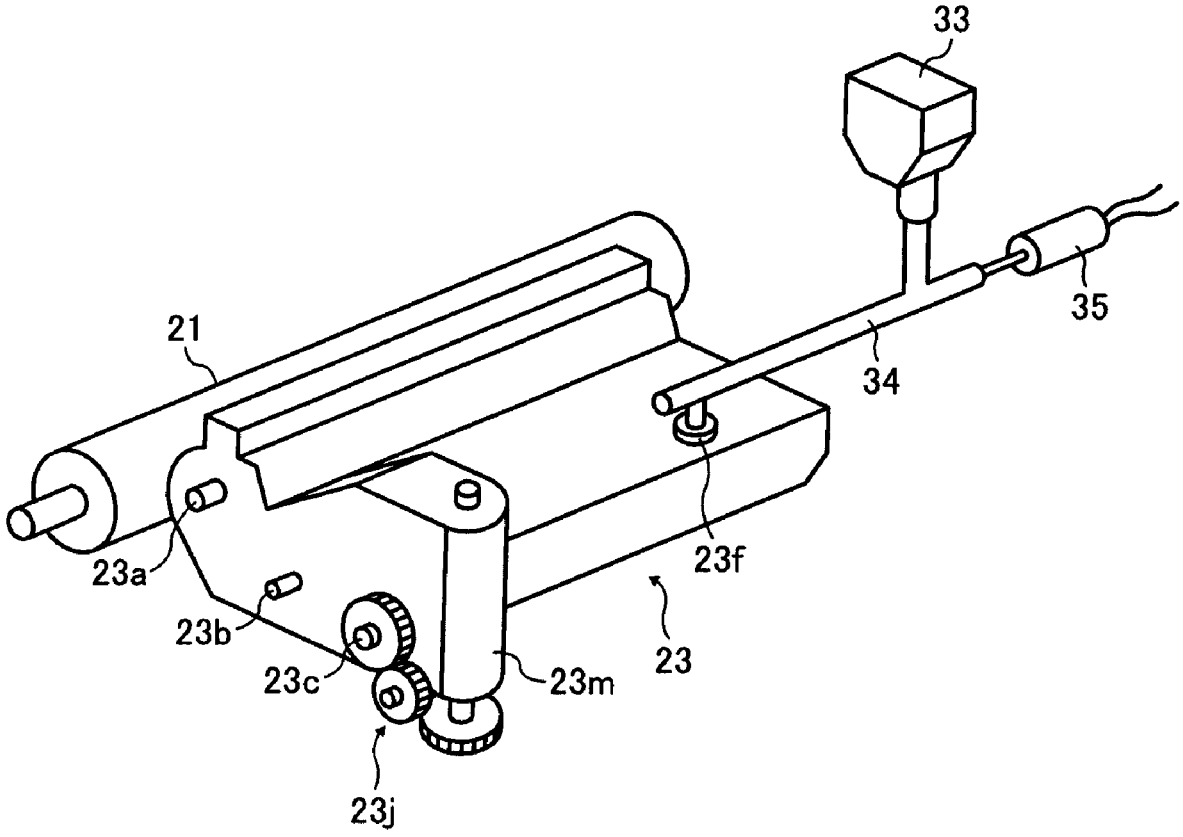
FIG. 2 is a schematic perspective view of a photoconductive drum 21 and a developing device 23 in the image forming apparatus 1 of the first embodiment.
Figure 3:
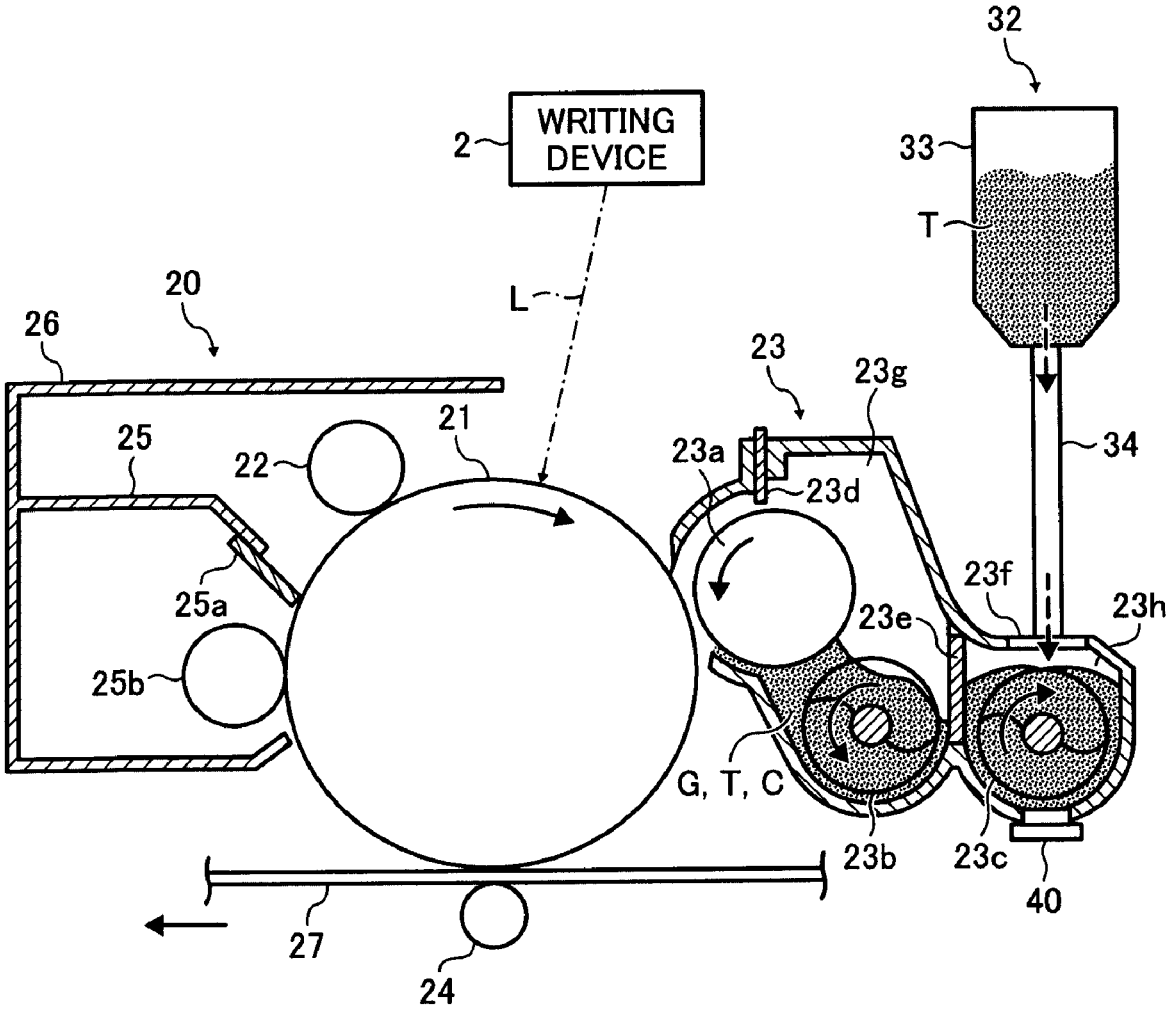
FIG. 3 is a schematic cross-sectional view of an image forming section in the image forming apparatus 1 of the first embodiment taken along a center of the image forming section in the longitudinal direction.
Figure 4:
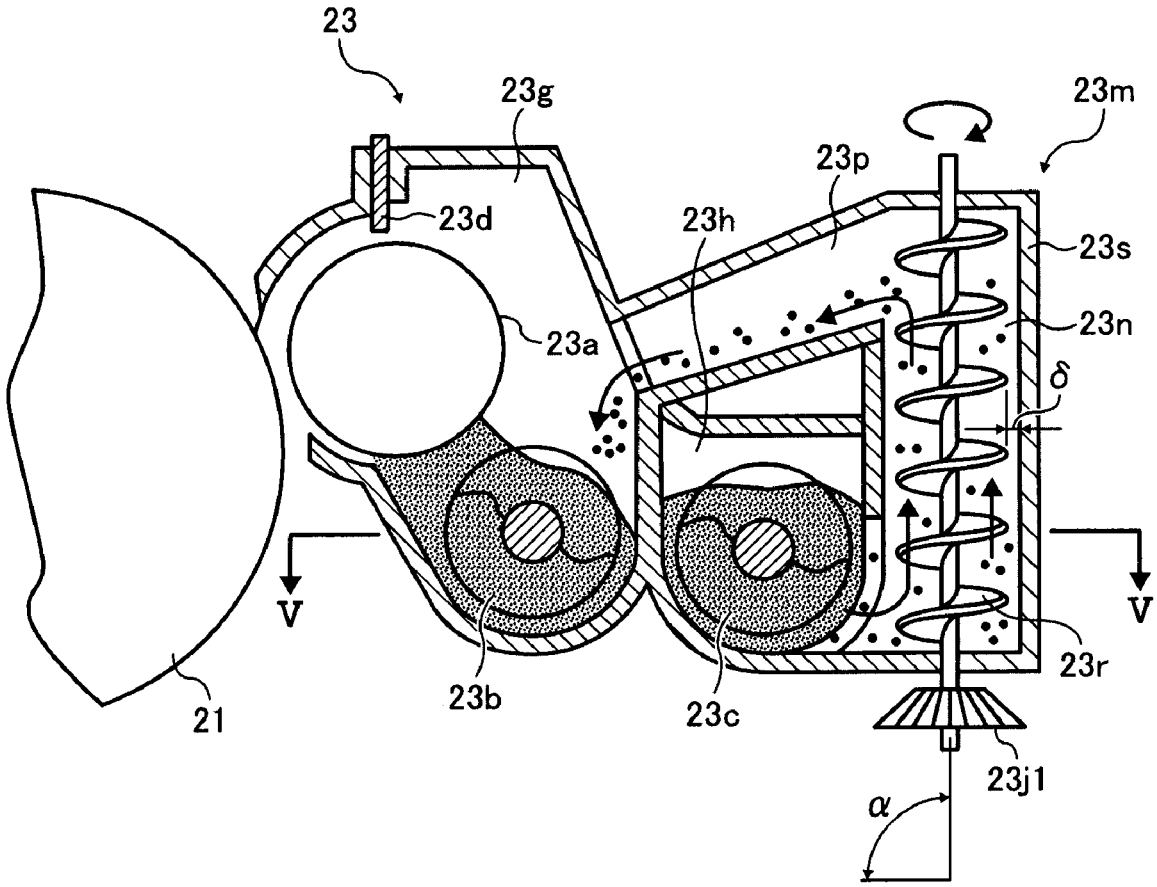
FIG. 4 is a schematic cross-sectional view of the developing device 23 of the first embodiment taken along line IV.-IV.
Figure 5:
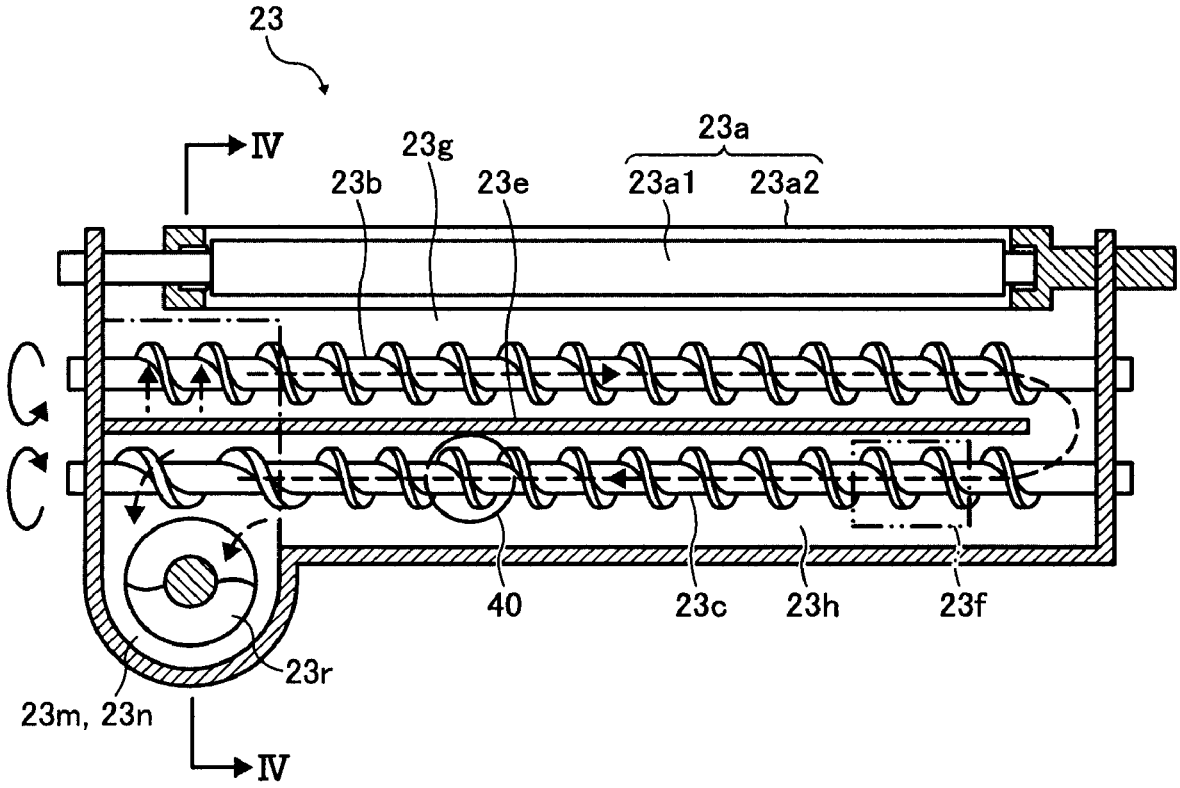
in FIG. 5 at an end of the developing device 23 in the longitudinal direction.

Hereinafter, an image forming section of the image forming apparatus 1 is explained with reference to FIGS. 2-5. FIG. 2 is a schematic perspective view of the photoconductive drum 21 and the developing device 23 in the image forming apparatus 1. FIG. 3 is a schematic cross-sectional view of an image forming section in the image forming apparatus 1 taken along a center of the image forming section in the longitudinal direction. FIG. 4 is a schematic cross-sectional view of the developing device 23 taken along line IV.-IV. in FIG. 5 at the end of the developing device 23 in the longitudinal direction. FIG. 5 is a schematic cross-sectional view of an arrangement of the conveying screws in the developing device 23 taken along line V.-V. in FIG. 4 at the center of the conveying screws in the vertical direction.

The image forming apparatus 1 includes four image forming sections for the image forming process. Because the four image forming sections have similar configurations except for a color of toner T, the reference characters of Y, M, C, and BK have been omitted from FIGS. 2-5 for the process cartridges, the developing devices, the toner supply devices, and other parts. In FIG. 2, configurations for the toner supply device 32 are simplified for the sake of explanation.

As shown in FIG. 3, the process cartridge 20 includes the photoconductive drum 21 as an image bearing member, the charger 22, and the cleaning device 25, which are encased in a case 26. The cleaning device 25 includes a cleaning blade 25*a* and a cleaning roller 25*b*, which are contactable to the photoconductive drum 21 as shown in FIG. 3.

The developing device 23 includes a developing roller 23*a*, a first conveying screw 23*b* that serves as a first conveying member, a second conveying screw 23*c* that serves as a second conveying member, a doctor blade 23*d*, a first agent compartment 23*g*, a bottom space of which serves as a first conveying route, and a second agent compartment 23*h*. A bottom space of the second agent compartment 23*h* serves as a second conveying route, as shown in FIGS. 3 and 4. The developing device 23 further includes a third conveying screw 23*r*, which serves as an agitate conveying member, and a third agent compartment 23*m*, at least a partial portion of which serves as an agitate conveying route (or upwardly extending portion), at the longitudinal end of the developing device 23 as shown in FIGS. 2 and 5.

The developing roller 23*a*, the doctor blade 23*d* and the first conveying screw 23*b* are arranged in the first agent compartment 23*g*. The developing roller 23*a* faces the photoconductive drum 21. The first conveying screw 23*b* is arranged in the bottom space of the first agent compartment 23*g*. The bottom space faces the developing roller 23*a*. The first conveying screw 23*b* also faces the developing roller 23*a* and further faces the second conveying screw 23*c* via a separator or separation wall 23*e* provided between the first conveying screw 23*b* and second conveying screw 23*c*. The doctor blade 23*d* faces the developing roller 23*a*.

A magnetic sensor 40, the replenishing port 23*f* and the second conveying screw 23*b* are arranged in the second agent compartment 23*c*. The second conveying screw 23*c* is arranged in the bottom space of the second agent compartment 23*h*. The first agent compartment 23*g* and the second agent compartment 23*h* are separated by the separator 23*e*.

As shown in FIG. 5, a left end of the separator 23*e* connects with the left wall of the developing device case and the first agent compartment 23*g* and the second agent compartment 23*h* are separated entirely. On the other hand, a right end of the separator 23*e* does not connect with the right wall of the developing device case and makes a right end passage between the first agent compartment 23*g* and the second agent compartment 23*h*.

As shown in FIG. 5, the third agent compartment 23*m* is formed at the other end of the passage. The third agent compartment 23*m* includes two passages that are connected to each other; namely, a raising up route (or upwardly extending portion) 23*n* and a sloping down route 23*p*. The raising up route 23*n* has a cylindrical wall 23*s* and extends upward in a vertical direction. A bottom space of the raising up route 23*n* connects to one end of the second agent compartment 23*m* via an opening arranged between the second conveying screw 23*c* and the third conveying screw 23*r*, and a top space of the raising up route 23*n* connects to one end of the sloping down route 23*n* as shown in FIG. 4. The third conveying screw 23*r* is arranged in the raising up route 23*n* extending up substantially in a vertical direction. The sloping down route 23*n* inclines from the top space of the raising up route 23*n* to a middle space of the first agent compartment 23*g*, which is above the bottom space of the compartment 23*g* and connects to the middle space via an opening arranged between the sloping down route 23*p* and the first agent compartment 23*g* as shown in FIG. 4. As a result, a circulation route is formed with the bottom of the first agent compartment 23*g*, the bottom of the second agent compartment 23*h* and the third agent compartment 23*m* in the developing device 23.

As shown in FIG. 5, the developing roller 23*a* includes a magnet 23*a*1, and a sleeve 23*a*2. The magnet 23*a*1 is provided inside the sleeve 23*a*2, and generates magnetic poles over the developing roller 23*a*. The sleeve 23*a*2, made of non-magnetic material, can rotate around the magnet 23*a*1. The magnet 23*a*1 generates a plurality of magnetic poles over the sleeve 23*a*2 of the developing roller 23*a* such as a main pole, a transport pole, a carrying-up pole, and an agent release pole. The developing roller 23*a* (or sleeve 23*a*2) is connected to a drive motor (not shown) in the image forming apparatus 1, and can be rotated by the drive motor (not shown). Although not shown in FIG. 2, the developing roller 23*a*, the first conveying screw 23*b*, the second conveying screw 23*c* and the third conveying screw 23*r* can be connected to each other by a gear system (not shown). Accordingly, when the drive motor rotates the developing roller 23*a*, the first conveying screw 23*b*, the second conveying screw 23*c*, and the third conveying screw 23*r* can also be rotated via the gear system (not shown).

A gear system 23*j* is arranged at the outer side of the third agent compartment 23*m* that includes three gears connected to each other as shown in FIG. 2. A bevel gear 23*j*1, which is one of the three connected gears, attaches to the shaft of the third conveying screw 23*r* as shown in FIG. 4. A driving force rotating a gear attached to the second conveying screw 23*c* is transmitted for use as a driving force rotating the third conveying screw 23*r* by the bevel gear 23*j*1.

As shown in FIGS. 3 and 4, the developing device 23 contains, for example, a two-component developing agent G having a toner T and carrier C (i.e., a magnetic component). In the first embodiment, the toner T of the developing agent G includes toner particles made of resin and colorant, and additives, for example. The toner T can be made by several methods such as a polymerization reaction of monomers (e.g., emulsion polymerization, or suspension polymerization), a levigation of resin with melting and spraying of resin, an adhering of additives to toner particles, dispersed in water, by mixing them with a Henschel mixer or the like. Resins for use in toner T includes homopolymer and copolymer of styrene (e.g., polystyrene, polychlorostyrene, or polyvinyltoluene) and derivative substitution of styrene; styrene copolymer such as styrene/p-chlorostyrene copolymer, styrene/propylene copolymer, styrene/vinyltoluene copolymer, styrene/vinylnaphthalene copolymer, styrene/methyl acrylate copolymer, styrene/ethyl acrylate copolymer, styrene/butyl acrylate copolymer, styrene/octyl acrylate copolymer, styrene/methyl methacrylate copolymer, styrene/ethyl methacrylate copolymer, styrene/butyl methacrylate copolymer, styrene/α-chlormethyl methacrylate copolymer, styrene/acrylonitrile copolymer, styrene/vinylmethylether copolymer, styrene/vinylethylether copolymer, styrene/vinylmethylketone copolymer, styrene/butadiene copolymer, styrene/isoprene copolymer, styrene/acrylonitrile/indene copolymer, styrene/maleic acid copolymer, styrene/maleate ester copolymer; polymethyl methacrylate, polybutylmethacrylate, polyvinyl chloride, polyvinyl acetate, polyethylene, polypropylene, polyester, polyvinylbutylbutyral, polyacrylic resin, rosin, modified rosin, terpene resin, phenol resin, aliphatic or alicyclic hydrocarbon resin, aromatic resin, chlorinated paraffin, and paraffin wax, for example. These resins can be used alone or a mixture of at least two resins can be used for toner T.

A colorant for black toner includes carbon black, aniline black, furnace black, and lamp black, for example. A colorant for cyan toner includes phthalocyanine blue, methylene blue, victoria blue, methyl violet, aniline blue, and ultramarine blue, for example. A colorant for magenta toner includes rhodamine 6G lake, dimethylquinacridone, watching red, rose bengal, rhodamine B, and alizarin lake, for example. A colorant for yellow toner includes chrome yellow, benzidine yellow, hansa yellow, naphthol yellow, molybdenum orange, quinoline yellow, and tartrazine, for example.

The toner T can include a small amount of charge-adding agent (e.g., pigment, or polarity control agent) to add an effective chargeability to toner T. The polarity control agent includes a metal complex of monoazo acid dye, nitrohumic acid and its salt, a metal-complex (e.g., Co, Cr, Fe) of several acids such as salicylic acid, naphthoic acid, and dicarboxylic acid, organic dye, and quaternary ammonium salt, for example.

Inorganic fine particles used for additives include silica, alumina, titanium oxide, barium titanate, magnesium titanate, calcium titanate, strontium titanate, ferric oxide, copper oxide, zinc oxide, tin oxide, silica sand, clay, mica isinglass, sand-lime, kieselgur, chrome oxide, cerium oxide, colcothar, antimony trioxide, magnesium oxide, zirconium oxide, barium sulfate, barium carbonate, calcium carbonate, silicon carbide, and silicon nitride, for example. Among these compounds, silica and titanium oxide may favorably prevent a submerging of additives in toner, and may improve chargeability of toner.

In an exemplary embodiment, the carrier C, which is in the two-component developing agent G and the carrier cartridge 48 (see FIG. 10), includes a core particle made of magnetic material, and a coating layer formed on the core particle. The core particle of carrier C includes ferromagnetic material such as iron, cobalt, and nickel, and an alloy or compound of magnetite, hematite, and ferrite, for example. The coating layer of the carrier C can be made of polyolefin resin such as polyethylene, polypropylene, chlorinated polyethylene, and chlorosulfonated polyethylene; polyvinyl and polyvinylidene resin such as polystyrene, acrylic resin (e.g., polymethyl methacrylate), polyacrylonitrile, polyvinylacetate, polyvinylalcohol, polyvinylbutyral, polyvinyl chloride, polyvinylcarbazole, polyvinylether and polyvinylketone; copolymer of polyvinyl chloride/vinyl acetate; copolymer of styrene/acrylic acid; silicon resin made of organosiloxane and its modified compound (e.g., modified compound of alkyd resin, polyester, epoxy resin, polyurethane); fluorine resin such as polytetrafluoroethylene, polyvinyl fluoride, polyvinylidene fluoride, polychlorotrifluoroethylene; polyamide; polyester such as polyethyleneterephthalate; polyurethane; polycarbonate; amino resin such as urea/formaldehyde resin; and epoxy resin, for example. Among these resins, acrylic resin, silicon resin, modified compound of acrylic resin or silicon resin, and fluorine resin are preferable to prevent so called "spent" phenomenon, and silicon resin or modified compound of silicon resin are more preferable to prevent the "spent" phenomenon. The coating layer can be coated on the core particle by spraying resin solution on a surface of core particle, or by immersing the core particle in resin solution.

The carrier C can also include fine particles in the coating layer to adjust electrical resistance of the carrier C. The fine particles dispersed in the coating layer preferably have a particle diameter of 0.01 μm to 5.0 μm, for example. Fine particles of 2 to 30 weight part are preferably added with a resin of 100 weight part, and more preferably fine particle of 5 to 20 weight part are added with a resin of 100 weight part.

The fine particles include silica, metal oxides (e.g. alumina, titania), and pigment (e.g., carbon black), for example.

Hereinafter, a developing process in the image forming process is explained with reference to FIGS. 2 and 3.

The developing roller 23*a* rotates in a direction shown by an arrow on the roller 23*a* in FIG. 3. The first transport screw 23*b*, and the second transport screw 23*c* rotate in respective directions shown by arrows in FIG. 3. The first conveying screw 23*b* includes a shaft and a first vane, which is a single spiral and is formed to convey the developing agent from left to right as shown in FIG. 5. The second conveying screw 23*c* includes a second vane, which is a single spiral and is formed to convey the developing agent from right to left as shown in FIG. 5. The third conveying screw 23*r* includes a third vane 23*r*1 (see FIG. 12), which is a single spiral and is formed to convey the developing agent from bottom to top as shown in FIG. 4. Accordingly, when the toner T (i.e., fresh toner) is supplied to the developing device 23 in a direction by dotted line arrows shown in FIG. 3 from the toner supply device 32 through a toner replenishing port 23*f*, which is provided in the developing device case above the second conveying screw, the developing agent G in the developing device 23 is agitatingly mixed with the toner T (i.e., fresh toner).

In detail, as shown with a left direction arrow on the second conveying screw 23*c* in FIG. 5, the second conveying screw 23*c* conveys the developing agent G from right to left and transports the developing agent G to the third conveying screw 23*r* via the opening arranged between the second conveying screw 23*c* and the third conveying screw 23*r*. The fresh toner is replenished properly via the toner replenishing port 23*f* by the toner supply device 32. The third conveying screw 23*r* conveys the developing agent G upward from the bottom space to the top space of the raising up route 23*n*. Some of the developing agent G falls down in a gravity direction via a gap between an inner surface of the cylindrical wall 23*s* of the raising up route 23*n* and a periphery of the vane 23*r*1 of the third conveying member 23*r*. The falling developing agent G collides moderately with the raising developing agent G that is being conveyed upward by the third conveying screw 23*r* not withstanding the gravity acting on the fresh toner, and diffuses into the developing agent G and is mixed with the agent G, and as a result, the fresh toner is charged in the raising up route 23*n* by friction. The slope down route 23*p* allows the charged developing agent G to flow down from the top space of the raising up route 23*n* to the first conveying screw 23*b* in the bottom space of the first agent compartment 23*g* via the opening between the route 23*p* and the compartment 23*g*, and the middle space of the compartment 23*g*.

As shown with a right direction arrow on the first conveying screw 23*b* in FIG. 5, the first conveying screw 23*b* conveys the developing agent from left to right and transports the developing agent to the second conveying screw 23*c* via the right end passage. As a result, the developing agent circulates a route formed by the bottom of the first agent compartment 23*g*, the bottom of the second agent compartment 23*h*, and the third agent compartment 23*m*. Some of the developing agent G moving in the first agent compartment 23*g* is borne by the developing roller 23*a* and used in the process of developing the image on the photoconductive drum 21. The developing agent G that has already been used in the process separates from the developing roller 23*a* and is conveyed by the first conveying screw 23*b* again.

In detail, the toner T may adhere on the carrier C with a frictional effect when the toner T and carrier C are agitatingly mixed in the developing device 23. Such toner T and carrier C (i.e., developing agent G) are carried up to the developing roller 23*a* as developing agent G. The developing agent G carried up on the developing roller 23*a* comes to a position facing the doctor blade 23*d* with a rotation of the developing roller 23*a*, wherein the doctor blade 23*d* is used to regulate an amount of developing agent G on the developing roller 23*a*. Then, the developing agent G on the developing roller 23*a*, regulated to a preferable amount by the doctor blade 23*d*, comes to a position facing the photoconductive drum 21. At such position, the toner T in developing agent G adheres onto the electrostatic latent image formed on the photoconductive drum 21. Specifically, an electric field is formed between the photoconductive drum 21 and developing roller 23*a* because an electric potential of electrostatic latent image, formed by irradiating the laser beam L on the photoconductive drum 21, and a developing bias potential applied to the developing roller 23*a* have a potential difference. The toner T can be adhered to the electrostatic latent image with an effect of such potential difference between the photoconductive drum 21 and developing roller 23*a*. The toner T adhered on the photoconductive drum 21 during the above-mentioned developing process is then transferred onto the intermediate transfer belt 27. Then, the cleaning blade 25*a* and cleaning roller 25*b* recover toner remained on the photoconductive drum 21 in the cleaning device 25. The developing agent G that has already been used in the developing process separates from the developing roller 23*a* and is conveyed by the first conveying screw 23*b* again.

The toner supply device 32 includes a toner cartridge 33, and a toner transport device (not shown), for example. The toner cartridge 33 stores the toner T (e.g., yellow, magenta, cyan, and black toner), and is removable from the image forming apparatus 1. The toner transport device transports the toner T (i.e., fresh toner) from the toner cartridge 33 to the developing device 23. The toner transport device (not shown) includes a toner transport route 34, toner transport screw (not shown) in the route 34, and a pulse driving motor 35, which connects with the toner transport screw and drives the toner transport screw as shown in FIG. 2. The toner T in the toner cartridge 33 can be supplied to the developing device 23, as required, through the toner replenishing port 23*f* when toner in the developing device 23 is consumed by image forming operations.

As shown in FIGS. 3 and 5, the developing device 23 includes the magnetic sensor 40 (i.e., toner concentration sensor) under the second conveying screw 23*c* to detect a consumption rate of toner in the developing device 23. The developing device 23 can also include a photosensor (not shown), which faces the photoconductive drum 21, to detect a consumption rate of toner in the developing device 23. If the magnetic sensor 40 or the photosensor detects that a toner concentration in the developing device 23 becomes lower than a target toner concentration, which is defined by a ratio of toner T in developing agent G, then the toner T is supplied from the toner supply device 32 to the developing device 23 through the toner supply port 23*f* until the magnetic sensor 40 or photosensor detects that a toner concentration in the developing device 23 becomes the target toner concentration. An amount of toner T supplied to the developing device 23 can be adjusted by the pulse driving motor 35, which controls the rotation number of the transport screw. Alternatively, a means of transporting the toner T in the toner transport route can be an air pump, instead of the toner transport screw and the pulse driving motor. The air pump makes an airflow from the toner cartridge 33 to the toner transport route 34 to transport toner T with the airflow.

As described above, the developing device of the first embodiment has a circulation route formed by the bottom of the first agent compartment 23*g*, the bottom of the second agent compartment 23*h*, and the third agent compartment 23*m*. In the circulation route, the developing agent is conveyed circulately by the first conveying screw 23*b*, the second conveying screw 23*c*, and the third conveying screw 23*r*.

In the raising up route 23*n* of the third agent compartment 23*m*, some of the developing agent G falls down in a gravity direction via a gap between the inner surface of the cylindrical wall 23*s* of the raising up route 23*n* and a periphery of the vane 23*r*1 of the third conveying member 23*r*. The falling developing agent G collides moderately with the raising developing agent G that is being conveyed upward by the third conveying screw 23*r* not withstanding the gravity acting on the fresh toner, and diffuses into the developing agent G and is mixed with the agent G, and as a result, the fresh toner is charged in the raising up route 23*n* by friction. Additionally, the falling developing agent G collides with the inner surface of the cylindrical wall 23*s* and the periphery of the vane 23*r*1 of the third conveying member 23*r*, and this collision helps the fresh toner to charge up by friction.

The toner replenishing port 23*f* is arranged at an upstream side of the second agent compartment 23*h* in a conveying direction of the developing agent and near the right end passage as shown in FIG. 5. The third agent compartment 23*m* is arranged at a downstream side of the toner replenishing port 23*f*. The flesh toner T, which has been already replenished to the circulation route, is agitatingly mixed with the developing agent G and diffuses into the developing agent G in the raising up route 23*n* until reaching the first agent compartment 23*g*. As a result, the fresh toner charged up with friction prevents toner scatter from occurring.

The third conveying screw 23*r* extends along the extending direction of the raising up route 23*n* and an angle α, which is between a longitudinal axis of the third conveying screw 23*r* and the horizontal plane, can be in a range 60 to 90°. The angle α in FIG. 4 is set at 90°. The third conveying screw 23*r*, whose angle is in the range 60 to 90°, can agitatingly mix the fresh toner T with the developing agent G in the raising up route 23*n*, whose conveying direction is from bottom to top. To make the fresh toner T agitatingly mix with the developing agent G and to defuse the fresh toner T into the developing agent G in the raising up route 23*n*, it is preferable to make the falling developing agent G collide moderately with the raising developing agent G under the force of gravity. If the third conveying screw 23*r*, is set at an angle α that is set under 60°, then the falling developing agent G, which falls down in a gravity direction via a gap between the inner surface of the cylindrical wall 23*s* of the raising up route 23*n* and a periphery of the vane 23*r*1 of the third conveying member 23*r*, will decrease and will not be able to sufficiently agitatingly mix the fresh toner T with the developing agent G.

The cylindrical wall 23*s* encloses the third conveying screw 23*r* and has a gap δ between the inner surface of the wall 23*s* and the periphery of the vane 23*r*1 of the screw 23*r*. The gap δ is in a range of 0.5 to 1.5 mm. This gap δ helps to make the falling developing agent G collide moderately with the raising developing agent G. The gap δ also helps to prevent the developing agent G from being significantly damaged.

Figure 6:
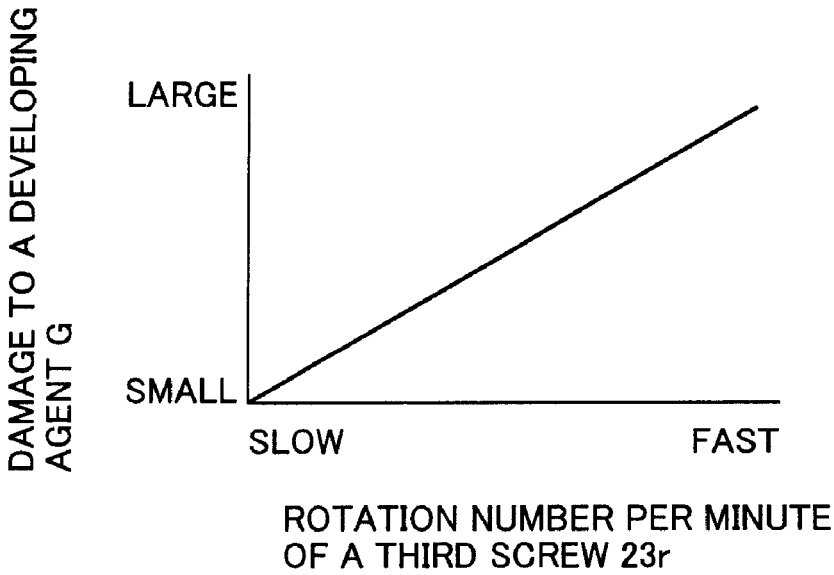
FIG. 6 is a graph that shows a relationship between a number of rotations per minute of the third screw 23*r* and damage caused to the developing agent G.

As shown in FIG. 6, a number of rotations per minute of the third screw 23*r* is in proportion to the amount or severity of damage caused to the developing agent G. The larger the rotation number per minute becomes, the more serious the damage caused to the developing agent G becomes. The damage of the developing agent G can be thought of as a decrease of the surface resistance of the carrier particles or as an amount of toner that adheres to the surface of the carrier particles.

Figure 7:
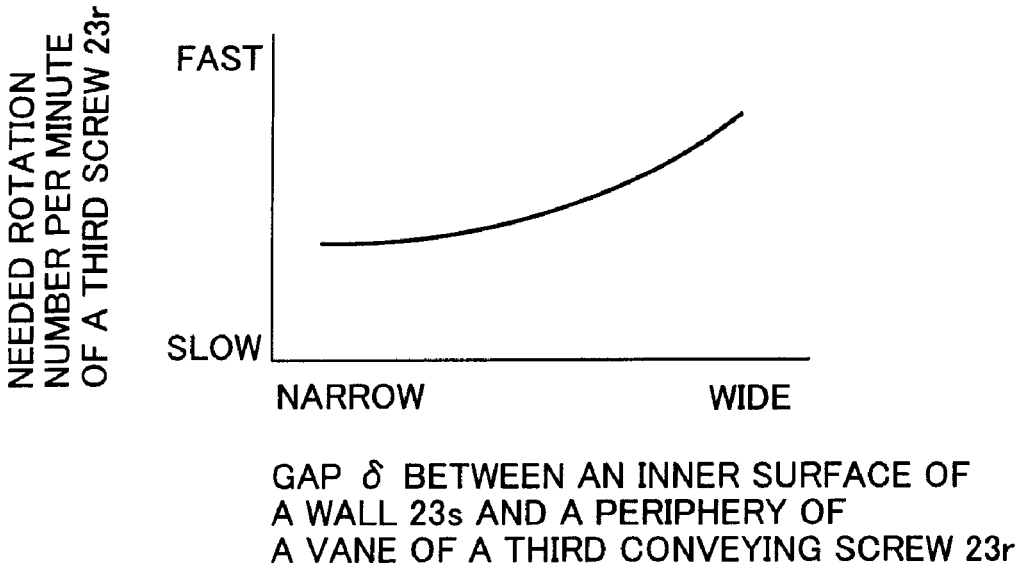
FIG. 7 is a graph that shows a relationship between a gap δ between an inner surface of a wall 23*s* and a periphery of a vane 23*r*1 (whose detail is shown in FIG. 12A) of a third conveying screw 23*r*, and a number of rotations per minute of the screw 23*r* needed to convey the developing agent.

As would be expected, an amount of the falling developing agent G increases when the size of the gap δ becomes wider. Therefore, as shown in FIG. 7, the number of rotations per minute of the third conveying screw 23*r* needs to become larger when the gap δ is increased in order to increase an amount of the developing agent G that the screw 23*r* carries up. The amount of developing agent G being carried upward balances moderately with the amount of the falling developing agent G. As a result, the relationship between the gap δ and the needed rotation number per minute of the third conveying screw 23*r* becomes a curve that has a lower aspect convex.

Figure 8:
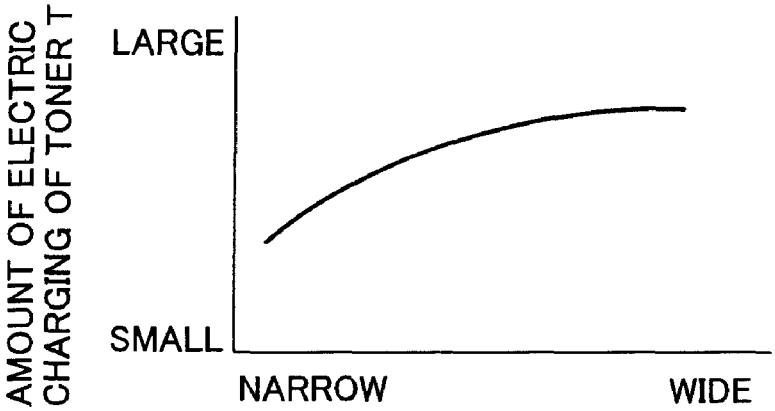
FIG. 8 is a graph that shows a relationship between the gap δ between the inner surface of the wall 23*s* and the periphery of the vane 23*r*1 of the screw 23*r*, and an amount of an electric charging of a toner T.

If the gap δ becomes wider, an amount of electric charging of the toner also increases as shown in FIG. 8. This phenomenon is due to the fact that the increased amount of falling developing agent G helps to mix the fresh toner with the developing agent G. However, the amount of electric charging of the toner does not increase in proportion to the width of the gap δ. The amount of electric charge on the toner is saturated if the width of the gap δ exceeds a certain value. As a result, the relationship between the gap δ and the amount of electric charging of the toner becomes a curve that has an upper aspect convex.

As understood by comparing FIG. 7 with FIG. 8, if the gap δ is narrow, the amount of electric charging of the toner increases corresponding to the width of the gap δ. The rotation number per minute of the third conveying screw 23*r* does not need to become very fast. However, if the increase amount of electric charging of the toner is saturated, then the rotation number per minute of the third conveying screw 23*r* needs to sharply increase in order to make the amount of electric charging of the toner larger. A large increase in the rotation number per minute of the third conveying screw 23*r* causes damage to the developing agent G. In some experiments, a gap δ over 1.5 mm saturates the amount of electric charging of the toner. In this case, if the rotation number per minute of the third conveying screw 23*r* is increased to make the amount of electric charging of the toner larger, then the increase in the rotation number per minute of the third conveying screw 23*r* makes the damage of the developing agent G larger.

Figure 9:
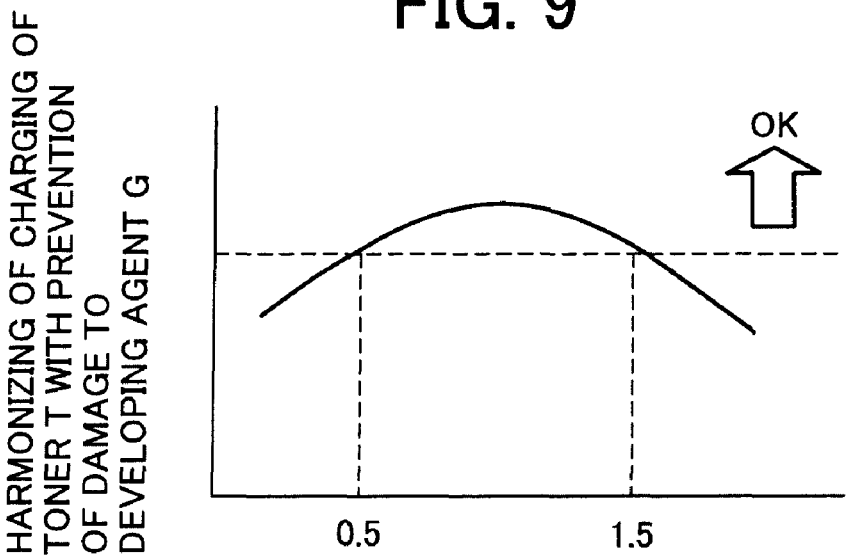
FIG. 9 is a graph that shows a relationship between a gap δ between the inner surface of the wall 23*s* and the periphery of the vane 23*r*1 of the screw 23*r*, and a harmonization of the charging of the toner T with prevention of damage to the developing agent G of the first embodiment.

In other experiments, a gap δ under 0.5 mm can make the damage to the developing agent G relatively small. However, the amount of electric charging of the toner is insufficient. Consequently, as shown in FIG. 9, a gap δ in a range of 0.5 to 1.5 mm makes the third conveying member 23*r* mix the fresh toner T with the developing agent G to get a sufficient amount of electric charging of the toner without making the damage of the developing agent G larger.

In the above-discussed example embodiment, each of the process cartridges 20Y, 20M, 20C, and 20BK integrally includes the photoconductive drum 21, charger 22, and cleaning device 25, and each of the developing devices 23Y, 23M, 23C, and 23BK is a separate component with respect to the process cartridges 20Y, 20M, 20C, and 20BK. However, each of the process cartridges 20Y, 20M, 20C, 20BK can also integrally include each of the developing device 23Y, 23M, 23C, and 23BK. Specifically, the process cartridge 20 can include the photoconductive drum 21, charger 22, developing device 23, and cleaning device 25. By integrating the developing device 23 with the process cartridge 20, a maintenance work of the image forming section can be improved.

Figure 10:
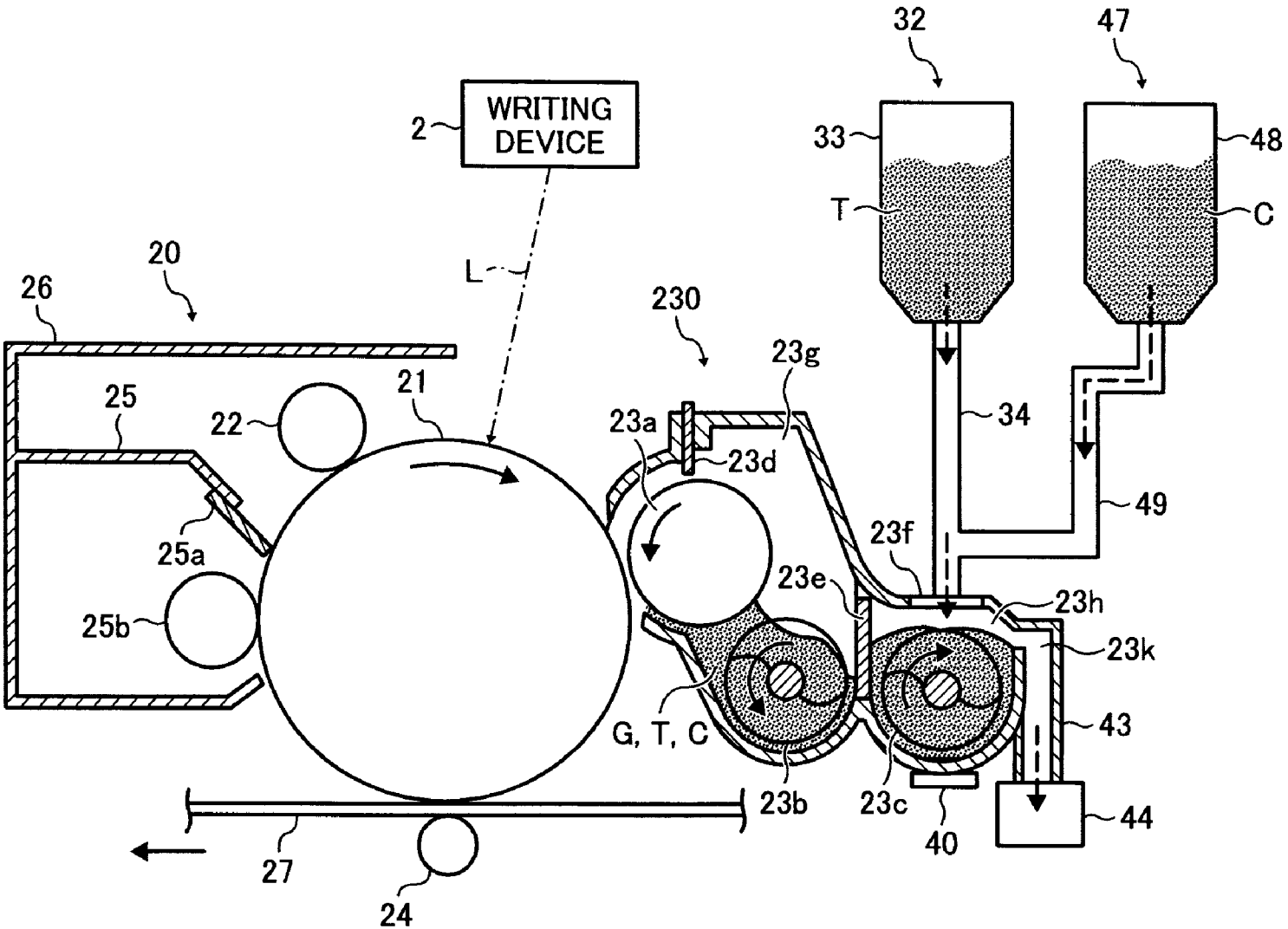
FIG. 10 is a schematic cross-sectional view of an image forming section in a developing device 230 of a second embodiment taken along a center of the image forming section in the longitudinal direction.

FIG. 10 shows a second embodiment of the present invention. FIG. 10 is a schematic cross-sectional view of the photoconductive drum 21 and the developing device 230 in an image forming apparatus, which corresponds to the view in FIG. 3. The image forming apparatus in the second embodiment includes the same components as the image forming apparatus in the first embodiment with the exception of some parts described below.

The developing device 230 employs a trickle developing method for toner and carrier supply. The developing device 230 includes a carrier supply device 47 and an ejection port 23*k*, which the developing device 23 does not include. The carrier supply device 47 supplies carrier particles C from a carrier cartridge 48 to the developing device 230 via a carrier transport route 49. The ejection port 23*k* ejects a part of the developing agent G in the developing device 230 to an outside of the developing device 230.

Specifically, as shown in FIG. 10, the second agent compartment 23*h* is connected to the toner supply device 32 and carrier supply device 47. The carrier supply device 47 includes the carrier cartridge 48, and a carrier transport device. The carrier cartridge 48 stores the carrier C (i.e., fresh carrier), and is removable from the image forming apparatus 1. The carrier transport device transports the carrier C (i.e., fresh carrier) from the carrier cartridge 48 to the developing device 230 through the replenishing port 23*f* shown in FIG. 10. The carrier transport device includes the carrier transport route 49, which connects to the middle part of the toner transport route 34, a carrier transport screw (not shown) that is arranged in the carrier transport route 49, and a pulse driving motor (not shown), which is also arranged in the carrier transport route 49 and connects to the carrier transport screw.

An amount of carrier C supplied to the developing device 230 can be adjusted by the pulse driving motor, which controls the rotation time of the carrier transport screw or the rotation frequency of the carrier transport screw. Alternatively, a means of transporting the carrier C in the toner transport route can be an air pump, instead of the carrier transport screw and the pulse driving motor. The air pump makes an airflow from the carrier cartridge 48 to the carrier transport route 49 to transport carrier C with the airflow.

As shown in FIG. 10, the second agent compartment 23*h* includes the ejection port 23*k* at an upper portion of the second agent compartment 23*h*. When the carrier supply unit 47 supplies the carrier C (i.e., fresh carrier) to the developing device 230, an amount of the developing agent G in the developing device 230 may exceed a target amount in the developing device 230. If such condition occurs, an excessive developing agent G can be ejected outside the developing device 230 from the ejection port 23*k*. Such developing agent G ejected from the ejection port 23*k* is transported to an agent recovery device 44 through an agent recovery route 43 as shown in FIG. 10. Specifically, when a height of developing agent G in the second agent compartment 23*h* becomes higher than a height of the ejection port 23*k* during a supplying operation of carrier C (i.e., fresh carrier), then the developing agent G starts to overflow from the ejection port 23*k*, by which a height of developing agent G in the developing device 230 can be maintained at a given level.

In the second embodiment, the developing agent is ejected from the developing device 230 by an overflow method as above described. However, other methods can be conducted for ejecting the developing agent from the developing device 230. For example, the ejection port 23*k* can be provided with a shutter, which can be opened and closed, by which the developing agent can be ejected from the developing device 230 by opening and closing the shutter.

The developing device 230 includes a circulation route formed by the bottom of the first agent compartment 23*g*, the bottom of the second agent compartment 23*h*, and the third agent compartment 23*m*. The developing device 230 also includes the first conveying screw 23*b*, the second conveying screw 23*c*, and the third conveying screw 23*r*, which makes the developing agent G circulate in the circulation route, as in the first embodiment. The developing device 230 includes the same structure as shown in FIG. 4, which is arranged in the longitudinal end of the device 230. The developing device 230 agitatingly mixes the replenished toner T and carrier C with the developing agent G.

In the second embodiment, the above-mentioned trickle developing method is used to prevent a degradation in image quality of the printed image caused by aging (or degradation) of carriers. Specifically, a part of the two-component developing agent used in the developing unit is ejected to an outside of the developing unit, as required, to reduce an amount of degraded carriers whose charge up performance is deteriorating. In the second embodiment, the fresh carrier C is supplied from the carrier supply device 47 as above described. Alternatively, a fresh developing agent G can be supplied from the device 47. The fresh developing agent G can be stored in the carrier cartridge 48 instead of the fresh carrier C.

Figure 11:
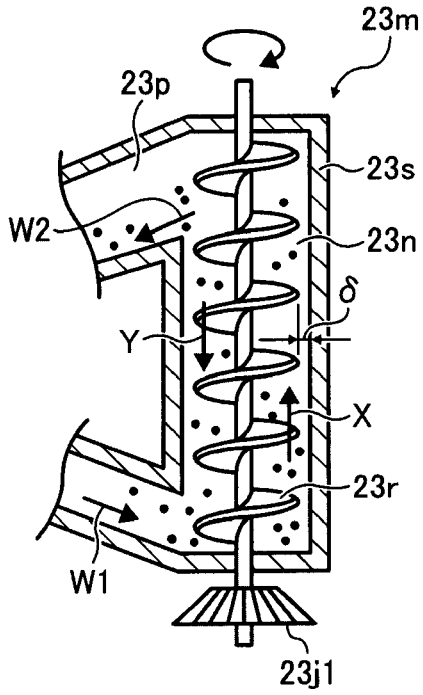
FIG. 11 is a schematic partial cross-sectional view of the developing device 231 of a third embodiment taken along an end of the developing device 231 in the longitudinal direction.

FIG. 11 shows a third embodiment of the present invention. FIG. 11 is a schematic cross-sectional view of a third agent compartment 23*m* of a developing device taken along a line at the end of the developing device 23 in the longitudinal direction. To understand the function of the third agent compartment 23*m* more clearly, some arrows W1, W2, X, and Y have been added to explain the third agent compartment depicted in FIG. 11. In FIG. 11, left side components from the second agent compartment of the developing device have been omitted, since these components are the same as in the developing device 23 shown in FIG. 4.

In FIG. 11, an input amount of the developing agent G is input into the raising up route 23*n* of the third agent compartment 23*m* as shown by arrow W1. An output amount of the developing agent G is output from the raising up route 23*n* of the third agent compartment 23*m* as shown by arrow W2. The gap δ is the width between the inner surface of the cylindrical wall 23*s* and the periphery of the vane 23*r*1 of the screw 23*r*. A raising up amount of developing agent G that is conveyed up by the third conveying screw 23*r* against the force of gravity is shown by arrow X. And a falling amount of developing agent G that falls down via the gap δ is shown by arrow Y.

In the third embodiment, the third conveying screw 23*r* and the gap δ are selected to give the raising developing agent X and the falling developing agent Y values so that the input amount W1 is substantially equal to the output amount W2. The relationship among the developing agent amounts W1, W2, X, and Y is described by the equation:

$$W1 \approx X - Y \approx W2.$$

The rotation number per minute of the third conveying screw 23*r*, which effects the amount of raising developing agent X, is adjusted to achieve the relationship. The gap δ, which effects the amount of falling developing agent Y, can also be set to achieve the relationship. In other words, the shape of the vane 23*r*1 and the rotation number per minute of the third conveying screw 23*r* are improved so that the input amount W1 is substantially equal to the output amount W2.

The developing device 23 of the third embodiment prevents the flow of the developing agent G from becoming locally stagnant in the circulation route formed by the bottom of the first agent compartment 23*g*, the bottom of the second agent compartment 23*h*, and the third agent compartment

23*m*. Accordingly, the developing device 23 of third embodiment prevents defective local conveyance or defective local charge up of the developing agent G from occurring.

Figure 12A:
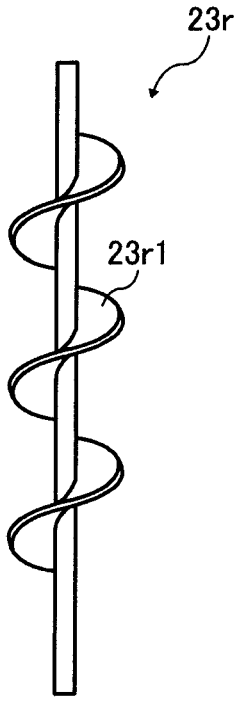
FIG. 12A is a schematic view of a third conveying screw 23*r* according to the first and second embodiments.
Figure 12B:
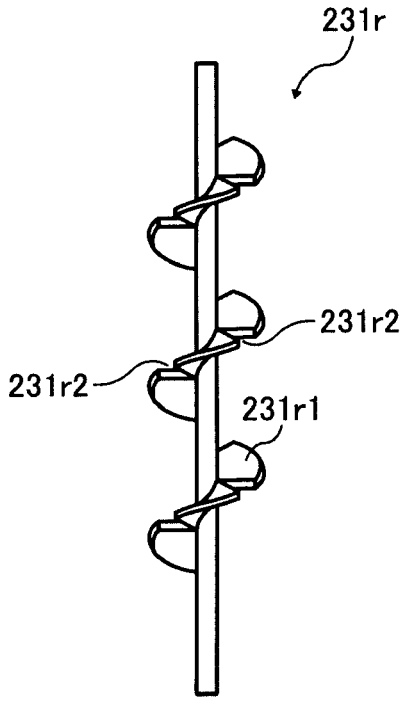
FIG. 12B is a schematic view of an improved alternative embodiment of a third conveying screw 231*r*.

Alternatively, the third agent compartment 23*m* can be equipped with the third conveying screw 231*r* as depicted in FIG. 12B, instead of the screw 23*r* shown in FIG. 12A, in order to give the amount of raising developing agent X and the amount of falling developing agent Y desired values to achieve the desired input amount and the desired output amount. As shown in FIG. 12A, the third conveying screw 23*r* has a spiral vane 23*r*1. The conveying screw 231*r* shown in FIG. 12B includes a vane 231*r*1 with recessed portions 231*r*2, such as concave portions, notches, etc., at the periphery of the vane 231*r*1. The third conveying screw 231*r* decreases the amount of raising developing agent X and increases the amount of falling developing agent Y as compared with the third conveying screw 23*r*. The developing device 23 that includes the third conveying screw 231*r* gives the amount of raising developing agent X and the amount of falling developing agent Y the desired values.

The above embodiments each include a supply and circulation system configured to receive developing agent from a supplying device, and configured to supply the developing agent to a developing roller and circulate the developing agent within the developing device. The supply and circulation systems in the above embodiments include, for example, the first conveying screw 23*b*, the second conveying screw 23*c*, the third conveying screw 23*r*, the first agent compartment 23*g*, the second agent compartment 23*h*, the third agent compartment 23*m*, and the toner supply port 23*f*, and are supplied by the toner supply device 32. The supplying device may further include the carrier supply device 47. However, the present invention can be provided in numerous different configurations. For example, the developing devices of the above embodiments all include the second agent compartment 23*h*, which is independent from the first agent compartment 23*g*. However, the present invention can be embodied in other types of developing devices, for example, a developing device that does not include a second agent compartment, but rather has a toner supply port 23*f* at the top wall of the first agent compartment 23*g*, or a developing device that includes more than two agent compartments whose conveyance directions of the developing agent are arranged in a horizontal plane. In fact, the developing device of the present invention can be embodied in any developing device configuration, such that a system is provided in the developing device to supply developing agent to the developing roller and an upwardly extending portion is provided in a circulation route therein.

Numerous additional modifications and variations are possible in light of the above teachings. It is therefore to be understood that within the scope of the appended claims, the disclosure of the present invention may be practiced otherwise than as specifically described herein.

What is claimed is:

1. A developing device for an image forming apparatus using developing agent supplied from a supplying device, said developing device comprising:

a developing roller configured to bear the developing agent thereon and develop a toner image on an image bearing member of the image forming apparatus; and a supply and circulation system configured to receive developing agent from the supplying device, said system being configured to supply the developing agent to said developing roller and circulate the developing agent within said developing device, said system including:

an agitate conveying member, and a circulation route having at least a portion that extends upward, wherein said agitate conveying member is provided within said upwardly extending portion of said circulation route, wherein said agitate conveying member is configured to convey the developing agent upward through said upwardly extending portion of said circulation route, wherein said upwardly extending portion includes a space configured to allow some of the developing agent being conveyed through said upwardly extending portion to fall, wherein said upwardly extending portion includes a wall enclosing said agitate conveying member, the space includes a gap between an inner surface of said wall and a periphery of said agitate conveying member, and the gap is in a range of 0.5 to 1.5 mm.

2. The developing device according to claim 1, wherein said agitate conveying member is configured to have a longitudinal axis that extends in a direction at an angle with respect to a horizontal plane in a range of 60° to 90°.

3. A developing device for an image forming apparatus using developing agent supplied from a supplying device, said developing device comprising:

a developing roller configured to bear the developing agent thereon and develop a toner image on an image bearing member of the image forming apparatus; and a supply and circulation system configured to receive developing agent from the supplying device, said system being configured to supply the developing agent to said developing roller and circulate the developing agent within said developing device, said system including:

an agitate conveying member, a circulation route having at least a portion that extends upward, a first conveying route facing said developing roller, a first conveying member arranged in said first conveying route, said first conveying member being configured to convey the developing agent in a longitudinal direction along said developing roller, a second conveying route facing said first conveying route, said second conveying route and said first conveying route having a separation wall therebetween, said separation wall having an opening connecting said second conveying route and said first conveying route, and a second conveying member arranged in said second conveying route, said second conveying member being configured to convey the developing agent in an opposite direction to said first conveying member, wherein said agitate conveying member is provided within said upwardly extending portion of said circulation route, wherein said agitate conveying member is configured to convey the developing agent upward through said upwardly extending portion of said circulation route, and wherein said upwardly extending portion includes a space configured to allow some of the developing agent being conveyed through said upwardly extending portion to fall.

4. The developing device according to claim 3, wherein said agitate conveying member is configured to convey an amount of the developing agent upward against an amount of the developing agent falling down through the space, so that an output amount of the developing agent from said circulation route is substantially equal to an input amount of the developing agent into said circulation route.

5. The developing device according to claim 4, wherein:

said circulation route includes said first conveying route, said second conveying route, and said upwardly extending portion;

an upstream side of said upwardly extending portion connects to a downstream side of said second conveying route; and a downstream side of said upwardly extending portion connects to an upstream side of said first conveying route in a conveying direction of the developing agent.

6. The developing device according to claim 5, wherein:

said system includes a replenishing port configured to receive new developing agent from the supplying device;

said replenishing port is provided along said second conveying route, and the upstream side of said upwardly extending portion connects to a downstream side of said replenishing port in the conveying direction of the developing agent.

7. The developing device according to claim 4, further comprising:

a replenishing device configured to replenish the developing agent with new carrier particles; and a discharging device configured to discharge at least a portion of the developing agent out of said developing device.

8. The developing device according to claim 7, wherein said replenishing device is configured to replenish the developing agent with new carrier particles and new toner particles.

9. A developing device for an image forming apparatus using developing agent supplied from a supplying device, said developing device comprising:

a developing roller configured to bear the developing agent thereon and develop a toner image on an image bearing member of the image forming apparatus; and a supply and circulation system configured to receive developing agent from the supplying device, said system being configured to supply the developing agent to said developing roller and circulate the developing agent within said developing device, said system including:

an agitate conveying member, and a circulation route having at least a portion that extends upward, wherein said agitate conveying member is provided within said upwardly extending portion of said circulation route, wherein said agitate conveying member is configured to convey the developing agent upward through said upwardly extending portion of said circulation route, wherein said upwardly extending portion includes a space configured to allow some of the developing agent being conveyed through said upwardly extending portion to fall, and wherein said agitate conveying member is configured to convey an amount of the developing agent upward against an amount of the developing agent falling down through the space, so that an output amount of the developing agent from said circulation route is substantially equal to an input amount of the developing agent into said circulation route.

10. The developing device according to claim 9, wherein:

said upwardly extending portion includes a cylindrical wall;

said agitate conveying member is a screw member configured to rotate within said cylindrical wall;

the amount of the developing agent conveyed upward by said screw member is set using a number of rotations per minute of said screw member; and an amount of the developing agent falling down through the space is set using a gap between an inner surface of said cylindrical wall and a periphery of said screw member.

11. The developing device according to claim 10, wherein said screw member includes a vane having a recessed portion.

12. A process cartridge for an image forming apparatus using developing agent supplied from a supplying device, said process cartridge comprising:

an image bearing member configured to bear a toner image; and a developing device including:

a developing roller configured to bear the developing agent thereon and develop the toner image on said image bearing member, and a supply and circulation system configured to receive developing agent from the supplying device, said system being configured to supply the developing agent to said developing roller and circulate the developing agent within said developing device, said system including:

an agitate conveying member, a circulation route having at least a portion that extends upward, a first conveying route facing said developing roller;

a first conveying member arranged in said first conveying route, said first conveying member being configured to convey the developing agent in a longitudinal direction along said developing roller, a second conveying route facing said first conveying route, said second conveying route and said first conveying route having a separation wall therebetween, said separation wall having an opening connecting said second conveying route and said first conveying route, and a second conveying member arranged in said second conveying route, said second conveying member being configured to convey the developing agent in an opposite direction to said first conveying member, wherein said agitate conveying member is provided within said upwardly extending portion of said circulation route, wherein said agitate conveying member is configured to convey the developing agent upward through said upwardly extending portion of said circulation route, and wherein said upwardly extending portion includes a space configured to allow some of the developing agent being conveyed through said upwardly extending portion to fall.

13. A process cartridge for an image forming apparatus using developing agent supplied from a supplying device, said process cartridge comprising:

an image bearing member configured to bear a toner image; and a developing device including:

a developing roller configured to bear the developing agent thereon and develop the toner image on said image bearing member, and a supply and circulation system configured to receive developing agent from the supplying device, said system being configured to supply the developing agent to said developing roller and circulate the developing agent within said developing device, said system including:

an agitate conveying member, and a circulation route having at least a portion that extends upward, wherein said agitate conveying member is provided within said upwardly extending portion of said circulation route, wherein said agitate conveying member is configured to convey the developing agent upward through said upwardly extending portion of said circulation route, and wherein said agitate conveying member is configured to convey an amount of the developing agent upward against an amount of the developing agent falling down through a space, so that an output amount of the developing agent from said circulation route is substantially equal to an input amount of the developing agent into said circulation route.

14. An image forming apparatus, comprising:

a supply device configured to supply a developing agent;

an image bearing member configured to bear a toner image; and a developing device including:

a developing roller configured to bear the developing agent thereon and develop the toner image on said image bearing member, and a supply and circulation system configured to receive developing agent from said supply device, said system being configured to supply the developing agent to said developing roller and circulate the developing agent within said developing device, said system including:

an agitate conveying member, and a circulation route having at least a portion that extends upward, wherein said agitate conveying member is provided within said upwardly extending portion of said circulation route, wherein said agitate conveying member is configured to convey the developing agent upward through said upwardly extending portion of said circulation route, and wherein said agitate conveying member is configured to convey an amount of the developing agent upward against an amount of the developing agent falling down through a space, so that an output amount of the developing agent from said circulation route is substantially equal to an input amount of the developing agent into said circulation route.

15. The image forming apparatus according to claim 14, wherein said developing device includes:

a replenishing device configured to replenish the developing agent with new carrier particles; and a discharging device configured to discharge at least a portion of the developing agent out of said developing device.

* * * * *